US011674090B1

(12) United States Patent
De Ren et al.

(10) Patent No.: US 11,674,090 B1
(45) Date of Patent: Jun. 13, 2023

(54) ENERGY OPTIMIZATION IN FLUID CATALYTIC CRACKING AND DEHYDROGENATION UNITS

(71) Applicant: Honeywell International Inc., Charlotte, NC (US)

(72) Inventors: Jan De Ren, Bracknell (GB); William J. Whyman, Collinsville, OK (US); Richard A. Johnson, II, Algonquin, IL (US); Jeffrey M. Knight, Downers Grove, IL (US); Anil Nivrutti Pachpande, Gurugram (IN); Andrew J. Craig, Glen Ellyn, IL (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 17/538,411

(22) Filed: Nov. 30, 2021

(51) Int. Cl.
*C10G 67/04* (2006.01)
*C10G 11/18* (2006.01)
*F01N 3/20* (2006.01)

(52) U.S. Cl.
CPC ..... *C10G 11/185* (2013.01); *F01N 3/2066* (2013.01); *C10G 2300/207* (2013.01)

(58) Field of Classification Search
CPC ..... C10G 11/185; C10G 2300/207; F01N 3/2066
See application file for complete search history.

(56) References Cited

U.S. PATENT DOCUMENTS 5,585,081 A 12/1996 Chu et al.
6,203,598 B1 3/2001 Hasegawa et al.
2008/0148735 A1 6/2008 McGehee
2011/0247336 A9* 10/2011 Farsad ..... B01D 53/78 60/685
2015/0007579 A1 1/2015 Curran et al.
2016/0116156 A1 4/2016 Victor et al.
2021/0324278 A1* 10/2021 Montalbano ..... B60K 17/02

FOREIGN PATENT DOCUMENTS

CN 2410046 A1 12/2001
CN 105214478 A 1/2016
CN 108295565 A 7/2018
KR 19990072635 A 9/1999

OTHER PUBLICATIONS

International Search Report from corresponding PCT application No. PCT/US2022/080639, dated Apr. 17, 2023.
Written Opinion from corresponding PCT application No. PCT/US2022/080639, dated Apr. 17, 2023.

* cited by examiner

*Primary Examiner* — Ellen M McAvoy
*Assistant Examiner* — Chantel L Graham

(57) ABSTRACT

Processes involving the use of a dry sorbent injection (DSI) unit or slurry reagent injection (SRI) unit to remove sulfur compounds form flue gas are described. Flue gas from an FCC regenerator, for example, is used to make superheated steam and saturated steam. The flue gas is then sent to a DSI unit to remove the sulfur compounds, and then to an economizer (or heat exchanger) to heat boiler feed water or combustion air. Because the temperature is not reduced as much as with a wet scrubber process, additional energy can be recovered in the economizer.

20 Claims, 1 Drawing Sheet

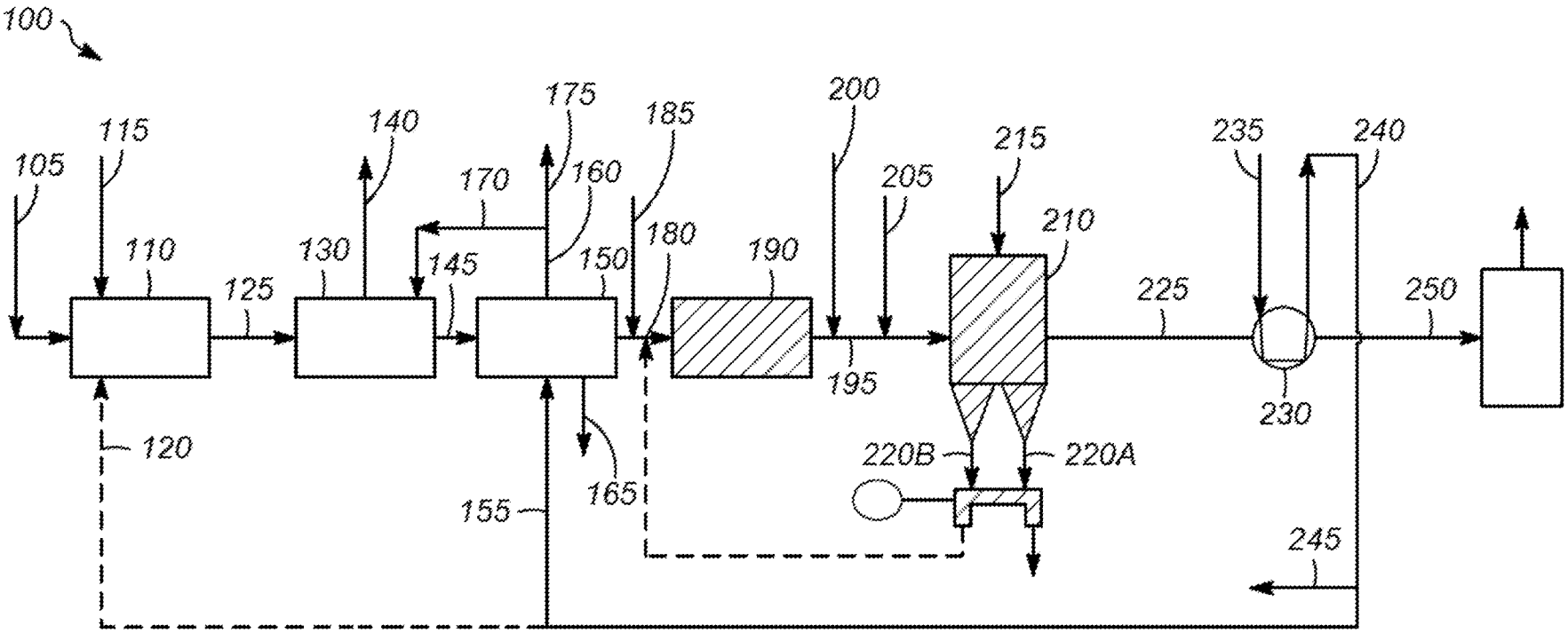
100
105
115
110
120
125
130
140
145
170
175
160
150
165
155
185
180
190
200
205
195
215
210
220A
220B
225
235
230
240
245
250

ENERGY OPTIMIZATION IN FLUID CATALYTIC CRACKING AND DEHYDROGENATION UNITS

BACKGROUND

Conventional treatment of flue gas from fluid catalytic cracking (FCC) units and fluidized bed dehydrogenation units involves the use of wet gas scrubbing technology, such as a caustic scrubber, to remove sulfur compounds from the flue gas. In this process, the flue gas from the FCC regenerator is heat exchanged with boiler feed water to make steam and cool the flue gas. The flue gas is further cooled from a temperature of 400-500° F. to a temperature of 140-194° F. using a water quench. The cooled flue gas is contacted with NaOH which reacts with the sulfur compounds to form Na2SO3 and/or Na2SO4 and water, which are removed. The flue gas can optionally be heated and treated to remove nitrogen compounds. The flue gas can also optionally be treated to remove catalyst fines and other particulate. The treated flue gas can then be discharged to the atmosphere.

However, the capital costs of the system are high, as are the operating costs due to the use of NaOH, water, electricity, flocculants, and slurry handling. Moreover, the system requires a large area and is maintenance intensive. The wet scrubber process has a high make-up water requirement due to water quenching and the use of aqueous NaOH. The system also suffers from corrosion problems related to the use of $H_2SO_4$, and spray nozzle fouling concerns due to the presence of salts. A substantial amount of sensible energy is not recovered because of $SO_3$ (acid) dew point limitations. The poor energy recovery is due to the high stack temperature and poor thermal profile (quench the boiler flue gas outlet to adiabatic saturation for allowing wet sulfur removal and in some cases subsequently reheating the flue gas to the needed Selective Catalytic Reduction (SCR) inlet temperature requirement to allow nitrogen (NOx) removal. This may may result in a negative energy balance. Furthermore, there can be issues of $H_2SO_4/SO_3$ blue plumes caused by formed submicron aerosols (H2SO4) and white plumes caused by water condensation when flue gas is emitted to atmosphere. This can be avoided by heating of the stream, but that increases capital and operating costs.

Therefore, there is a need for improved processes for treating flue gas containing sulfur compounds.

BRIEF DESCRIPTION OF THE DRAWING

The FIGURE illustrates one embodiment of a process according to the present invention.

DESCRIPTION OF THE INVENTION

The process involves the use of a dry sorbent injection (DSI) unit or a slurry reagent injection (SRI) unit to remove sulfur compounds from flue gas. Flue gas from an FCC regenerator, for example, is used to make superheated steam and saturated steam. The flue gas is then sent to a DSI unit to remove the sulfur compounds, and then to an economizer (or heat exchanger) to heat boiler feed water, thermal oil, or combustion air. Because the flue gas temperature does not reduce as much as with a wet scrubber process, additional thermal energy can be recovered from the flue gas in the economizer.

The increased energy recovery is directly correlated with the SOx content (acid dewpoint) of flue gas. By utilizing dry sorbent injection (DSI) or Slurry Reagent Injection (SRI) systems, the unharvested sensible energy can be captured, substantially improving the energy efficiency of FCC units and avoiding negative energy balances. The energy efficiency increase achieved by utilizing DSI and SRI systems in lieu of wet gas scrubber systems can also be applied to any type of FCC style process or fluidized dehydrogenation process where flue gas is generated with an SOx concentration above the environmental limit, e.g., full burn and partial burn FCC units, as well as fluidized bed type propane and/or butane dehydrogenation units.

The process results in a substantial increase in energy recovery due to the addition of an economizer downstream of the DSI (or an SCR) or the SRI and an improved heat profile (i.e., less reheating is needed for heating the effluent) in case of a downstream SCR. Energy optimization is realized by avoiding the need to cool flue gases to adiabatic saturation temperature (e.g., 140-194° F.). Instead, the temperature of the effluent after the sulfur removal and particulate removal by the dry scrubber system or the slurry reagent injection system is maintained. Therefore, the $SO_3$ dew point limitation on the HRSG boiler is removed, and additional sensible energy can be removed up to the water dew point by implementing a gas/gas and/or gas/liquid heat exchanger downstream of the dry scrubber system, slurry reagent injection system, or nitrogen removal unit (e.g., in the form of SCR). The recovered sensible energy can be used for preheating boiler feed water used in the HRSG boiler and/or catalyst cooler, thereby reducing or eliminating the possibility for negative energy balances. Low-pressure (LP) or medium pressure (MP) steam can be produced which can be used in the FCC process, the fluidized dehydrogenation process, and/or a solvent based carbon capture unit. The value created by additional energy recovery will increase with increasing sulfur content in the flue gas, as this limits the sensible heat recovery which can be done in the HRSG due to $SO_3$ dewpoint limitations.

The novel configuration allows for up to 20% additional thermal energy recovery by cooling the flue gas to about 300° F. rather than about 450° F. (which is enabled by performing the sulfur removal at 450° F.). The additional energy can be used to preheat combustion air for CO-combustor (if present) and/or DFAH, and/or boiler feed water for the HRSG and/or catalyst cooler (if present). The LP or MP stream can be used in the FCC process, the fluidized dehydrogenation process, and/or a solvent based carbon capture unit, as discussed above.

Sulfur removal upstream of the economizer reduces tube corrosion risks and greatly increases system reliability. The process reduces or eliminates corrosion ($H_2SO_4$) concerns in the sulfur removal step by staying above the water and acid dewpoint. Avoiding operation in the corrosive regime eliminates the need for a stainless steel flue gas scrubber; the complete system can be made from carbon steel.

Moreover, since the sulfur is removed, the flue gas outlet temperature at economizer can be decreased from about 450° F. to about 300° F. Therefore, additional preheating of the boiler feed water (BFW) to 350° F. is no longer required (typical BFW is 230-250° F.) which eliminates the need for circulating (steam drum) water pumps (at one third of the BFW flow) and the dew point issues of BFW. This results in improved reliability and reduced maintenance requirements (e.g., fewer tube failures resulting on fewer tube changes)

The dry scrubbing system or slurry injection system significantly reduces or eliminates the need for make-up water by avoiding the need for quenching the flue gas to adiabatic saturation temperature (140-194° F.), satisfying slurry handling concentration requirements, and maintaining the water balance. Because the DSI technology does not require water and water is considered a scarce resource, the water metric for the system is significantly improved. The make-up water consumption can be reduced by up to 60%.

The invention also eliminates spray nozzle fouling concerns by avoiding the need for complex slurry handling, white plumes as a result of water condensation, and blue plumes as a result of $H_2SO_4$ aerosol emissions. In addition, NOx reductions up to 21% may be achieved when using $NaHCO_3$ and the system pressure drop can be up to 50% lower. When using KOH as scrubbing reagent, the scrubbed residue will be $K_2SO_4/KNO_3$ fertilizer (about 4.47% CAGR) with a saleable value.

In a partial combustion FCC, the outlet temperature from the CO-combustor is 890-1040° C.

The outlet temperature from the FCC regenerator for a partial combustion FCC is about 650-700° C. For the full combustion FCC, the outlet temperature is about 690-740° C., while for the dehydrogenation process, the outlet temperature is about 690-760° C.

The flue gas outlet temperature from the HRSG for a partial combustion FCC, the full combustion FCC, and the dehydrogenation process is 200-290° C.

One aspect of the invention comprises a method for treating flue gas from a fluid catalytic cracking (FCC) unit catalyst regenerator, an FCC unit catalyst regenerator CO-combustor, or a dehydrogenation unit catalyst regenerator. In one embodiment, the method comprises: transferring heat from an flue gas stream from the FCC unit catalyst regenerator, the FCC unit catalyst regenerator CO-combustor, or the dehydrogenation reactor to a boiler feed water stream in a heat recovery steam generator (HRSG) to form a cooled flue gas stream and a steam stream, wherein the flue gas stream comprises one or more of sulfur-containing compounds, nitrogen-containing compounds, and catalyst fines and wherein the flue gas stream has a temperature in a range of 200° C. to 290° C., the temperature being above a dew point of water; reacting one or more of the sulfur-containing compounds, the nitrogen-containing compounds, or both in the cooled flue gas stream from the HRSG with a reactant in a decontamination reactor, wherein the reactant comprises one or more of $NaHCO_3$, NaOH, KOH to form a reactor effluent stream comprising one or more of Na2SO4, $NaNO_3$, $NaNO_2$, $Na_2CO_3$, $K_2SO_4$, and $KNO_3$ while maintaining the reactor effluent stream at a temperature in a range of 200° C. to 290° C.; filtering the reactor effluent stream to remove at least one of the $Na_2SO_4$, $NaNO_3$, $NaNO_2$, $Na_2CO_3$, $K_2SO_4$, $KNO_3$ and the catalyst fines and form a filtered reactor effluent stream; and pre-heating a combustion air stream or a boiler feed water stream with the filtered reactor effluent stream thereby reducing the temperature to 130° C. to 200° C. and staying above the dew point of water.

In some embodiments, pre-heating the combustion air stream or the boiler feed water stream with the filtered reactor effluent stream comprises pre-heating the combustion air stream or the boiler feed water stream with the filtered reactor effluent stream using a gas/gas heat exchanger or gas/liquid heat exchanger.

In some embodiments, the flue gas stream comprises a flue gas stream from a partial combustion FCC unit regenerator, and further comprising: combusting CO in the flue gas stream in a combustor to form a completely oxidized flue gas stream, wherein transferring heat from the flue gas stream comprises transferring heat from the completely oxidized flue gas stream.

In some embodiments, the combustion air stream is sent to the CO-combustor.

In some embodiments, filtering the reactor effluent stream comprises filtering the reactor effluent stream using a bag filter or an electrostatic precipitator.

In some embodiments, the method further comprises: dividing the filter material stream into two portions; recycling a first portion to the decontamination reactor; and recovering the second portion.

In some embodiments, the nitrogen-containing compounds are present in the cooled flue gas stream in an amount of less than 1000 ppm(v) on a dry basis.

In some embodiments, the sulfur-containing compounds are present in the cooled flue gas stream in an amount of less than 5000 ppm(v) on a dry basis.

In some embodiments, the HRSG comprises a superheated steam section and a saturated steam section, and wherein transferring heat from the flue gas stream to the boiler feed water stream comprises: introducing the flue gas stream into the superheated steam section to produce a superheated steam stream and a partially cooled flue gas stream; introducing the boiler feed water stream and the partially cooled flue gas stream into the saturated steam section to produce a saturated steam stream; introducing at least a portion of the saturated steam stream into the superheated steam section; and superheating the saturated steam stream with the flue gas stream to produce the superheated steam stream.

In some embodiments, the reactant is in dry form or slurry form.

Another aspect of the invention is a method for treating flue gas from a fluid catalytic cracking (FCC) unit catalyst regenerator, an FCC unit catalyst regenerator CO-combustor, or a dehydrogenation unit catalyst regenerator. In one embodiment, the method comprises: introducing a flue gas stream from the FCC unit catalyst regenerator, the FCC unit catalyst regenerator CO-combustor, or the dehydrogenation reactor into a superheated steam section of a heat recovery steam generator (HRSG) to produce a superheated steam stream and a partially cooled flue gas stream, wherein the HRSG comprises the superheated steam section and a saturated steam section, wherein the flue gas stream comprises one or more of sulfur-containing compounds, nitrogen-containing compounds, and catalyst fines, and wherein the flue gas stream has a temperature in a range of 200° C. to 290° C., the temperature being above a dew point of water; introducing a boiler feed water stream and the partially cooled flue gas stream into the saturated steam section of the HRSG to produce a saturated steam stream; introducing at least a portion of the saturated steam stream into the superheated steam section of the HRSG; superheating the saturated steam stream with the flue gas stream to produce the superheated steam stream; reacting one or more of the sulfur-containing compounds, the nitrogen-containing compounds, or both in the cooled flue gas stream from the HRSG with a reactant in a decontamination reactor, wherein the reactant comprises one or more of $NaHCO_3$, NaOH, KOH to form a reactor effluent stream comprising one or more of $Na_2SO_4$, $NaNO_3$, $NaNO_2$, $Na_2CO_3$, $K_2SO_4$, and $KNO_3$ while maintaining the reactor effluent stream at a temperature in a range of 200° C. to 290° C.; filtering the reactor effluent stream using a bag filter or an electrostatic precipitator to remove at least one of the $Na_2SO_4$, $NaNO_3$, $NaNO_2$, $Na_2CO_3$, $K_2SO_4$, $KNO_3$ and the catalyst fines and form a filtered reactor effluent stream; and pre-heating a combustion air stream or a boiler feed water stream with the filtered reactor effluent stream thereby reducing the temperature to 130° C. to 200° C. and staying above the dew point of water.

In some embodiments, pre-heating the combustion air stream or the boiler feed water stream with the filtered reactor effluent stream comprises pre-heating the combustion air stream or the boiler feed water stream with the filtered reactor effluent stream using a gas/gas heat exchanger or gas/liquid heat exchanger.

In some embodiments, the flue gas stream comprises a flue gas stream from a partial combustion FCC unit regenerator, and further comprising: combusting CO in the flue gas stream in a combustor to form a completely oxidized flue gas stream, wherein transferring heat from the flue gas stream comprises transferring heat from the completely oxidized flue gas stream.

In some embodiments, the combustion air stream is sent to the CO-combustor.

In some embodiments, the method further comprises: dividing the filter material stream into two portions; recycling a first portion to the decontamination reactor; and recovering the second portion.

In some embodiments, the nitrogen-containing compounds are present in the cooled flue gas stream in an amount of less than 1000 ppm(v) on a dry basis.

In some embodiments, the sulfur-containing compounds are present in the cooled flue gas stream in an amount of less than 5000 ppm(v) on a dry basis.

In some embodiments, the reactant is in dry form or slurry form.

Another aspect of the invention is an apparatus for treating flue gas from a fluid catalytic cracking (FCC) unit catalyst regenerator, an FCC unit catalyst regenerator CO-combustor, or a dehydrogenation unit catalyst regenerator. In one embodiment, the apparatus comprises: a heat recovery steam generator comprising a superheated steam section and a saturated steam section; the superheated steam section having a flue gas inlet, a flue gas outlet, a saturated steam inlet, and a superheated steam outlet, the flue gas inlet of the superheated steam section in fluid communication with an outlet of the FCC unit catalyst regenerator, the FCC unit catalyst regenerator CO-combustor, or the dehydrogenation unit catalyst regenerator; the saturated steam section having a flue gas inlet, a flue gas outlet, a boiler feed water inlet, and a saturated steam outlet, the flue gas inlet of the saturated steam section in fluid communication with the flue gas outlet of the superheated steam section, the saturated steam outlet of the saturated steam section in fluid communication with the saturated steam inlet of the superheated steam section; a decontamination reactor having a flue gas inlet, a flue gas outlet, and a reactant inlet, the flue gas inlet of the decontamination reactor in fluid communication with the flue gas outlet of the saturated steam section; a filter section having a flue gas inlet, a flue gas outlet, and a filter material outlet, flue gas inlet of the filter section in fluid communication with the flue gas outlet of the decontamination reactor inlet; a heat exchanger having a flue gas inlet and a flue gas outlet, the flue gas inlet of the heat exchanger in fluid communication with the flue gas outlet of the filter section, the heat exchanger in thermal communication with a boiler water feed stream; and the boiler water feed stream in fluid communication with the boiler feed water inlet of the saturated steam section.

In some embodiments, the CO-combustor has a flue gas inlet, a flue gas outlet, and a combustion air inlet, the flue gas outlet of the CO-combustor in fluid communication with the flue gas inlet of the superheated steam section, the heat exchanger in thermal communication with a combustion air stream, the combustion air stream in fluid communication with the combustion air inlet of the CO-combustor.

The FIGURE illustrates one embodiment of the process 100. With a partial burn FCC flue gas, the flue gas stream 105 is sent to a CO-combustor 110 with fuel gas stream 115 (or other fuel source) and combustion air 120 to burn the CO in the flue gas. The fully combusted stream 125 is then sent to the HRSG superheated steam unit 130. The flue gas outlet temperature for the FCC regenerator for a partial combustion FCC is in the range of about 650-700° C., and the temperature after the CO-combustor is about 890-1040° C.

For a full burn FCC regenerator or a dehydrogenation unit catalyst regenerator, the flue gas stream 105 is sent to the HRSG superheated steam unit 130, and the CO-combustor is not present. The flue gas outlet temperature for the full combustion FCC, it is in the range of about 650-760° C.; while for a dehydrogenation process it is in the range of 650-740° C.

The partially cooled flue gas stream 145 is sent to the HRSG saturated steam unit 150. Boiler feed water stream 135 is heated by the partially cooled flue gas stream 145 forming saturated steam stream 160 and condensate stream 165.

A portion 170 of the saturated steam stream 160 is sent to the HRSG superheated steam unit 130. The remainder 175 of the saturated steam stream 160 can be sent to other parts of the plant for use as needed.

The cooled flue gas stream 180 from the HRSG saturated steam unit 150 is mixed with a reactant 185 (dry or slurry) and sent to the decontamination reactor 190 where the reactant reacts with the sulfur-containing compounds. The filter zone 210 removes particulate and fines. Electricity is supplied to the filter zone 210 when the filter zone 210 comprises an electrostatic precipitator, and/or IA is supplied to the filter zone 210 comprises a bag filter. The filtered material including one or more of $Na_2SO_4$, $NaNO_3$, $NaNO_2$, $Na_2CO_3$, $K_2SO_4$, and $KNO_3$, and catalyst fines is removed from the filter zone 210. The filtered material 220A can be removed from process. Alternatively, or additionally, the filtered material 220B can be recycled to the decontamination reactor 190 to increase the $Na_2CO_3$ conversion yield (i.e. from 85 wt % to 98 wt %).

The filtered flue gas 225 is sent to heat exchanger 230 and heat exchanged with a stream 235 which can be boiler feed water or combustion gas to form a heated stream 240. If the heated stream 240 is boiler feed water, it can be sent to the HRSG saturated steam unit 150 as boiler water feed stream 155. If the heated stream 240 is combustion air, it can be sent to the CO-combustor 110. Alternatively, or additionally, all or a portion 245 of the heated stream 240 can be sent to other areas of the plant as needed. For example, heated boiler feed water could be sent to a catalyst cooler in the regenerator section, the main column bottoms stream generator, a reboiler in a downstream solvent-based $CO_2$ capture plant, and the like.

The heat exchanged flue gas stream 250 can be released to the atmosphere.

EXAMPLES

Example 1—Thermal Energy Recovery

A simulation was performed assuming full combustion with the FCC regenerator outlet at 704° C. (1300° F.) and 2% $O_2$. Table 1 shows the products of combustion.

TABLE 1

| Products of combustion | | | | |
|---|---|---|---|---|
| | SCFH | Mole % | lb/h | Mass % |
| $CO_2$ | 2,504,226 | 15.8% | 290,841 | 23.7% |
| $H_2O$ | 2,203,804 | 13.9% | 104,772 | 8.5% |
| $SO_2$ | 8,751 | 0.1% | 1,479 | 0.1% |
| $O_2$ | 286,754 | 1.8% | 24,214 | 2.0% |
| $N_2$ | 10,884,459 | 68.5% | 804,701 | 65.6% |
| Total | 15,887,994 | 100.0% | 1,226,007 | 100.0% |

In the base case, the temperature is reduced from 704° C. (1300° F.) to 232° C. (450° F.), leading to recovery of 289.9 MMBTU/hr.

Using the DSI system, the temperature is reduced from 704° C. (1300° F.) to 149° C. (300° F.), leading to recovery of 337.0 MMBTU/hr, which is a 16% increase in energy recovery (47.1 MMBTU/hr).

A simulation was performed assuming partial combustion with the CO-combustor outlet at 982° C. (1800° F.) and 2% $O_2$. Table 2 shows the products of combustion.

TABLE 2

| Products of combustion | | | | |
|---|---|---|---|---|
| | SCFH | Mole % | lb/h | Mass % |
| $CO_2$ | 2,882,769 | 13.5% | 334,805 | 20.6% |
| $H_2O$ | 2,894,037 | 13.6% | 137,587 | 8.5% |
| $SO_2$ | 8,959 | 0.0% | 1,515 | 0.1% |
| $O_2$ | 391,900 | 1.8% | 33,093 | 2.0% |
| $N_2$ | 15,109,228 | 71.0% | 1,117,043 | 68.8% |
| Total | 21,286,893 | 100.0% | 1,624,043 | 100.0% |

In the base case, the temperature is reduced from 982° C. (1800° F.) to 232° C. (450° F.), leading to recovery of 629.7 MMBTU/hr.

Using the DSI system, the temperature is reduced from 982° C. (1300° F.) to 149° C. (300° F.), leading to recovery of 692.3 MMBTU/hr, which is a 10% increase in energy recovery (62.5 MMBTU/hr).

Example 2—Desulfurization Make-Up Water Usage

Table 3 shows an FCC flue gas stream—flow rate, SOx content and $NaHCO_3$ make-up requirement to desulfurize the flue gas. The objective of this table is to illustrate that no make-up water is required to desulfurize the flue gas stream. Following desulfurization reactions are taking place:

$$2NaHCO_3 \rightarrow Na_2CO_3 + CO_2 + H_2O$$

$$Na_2CO_3 + SO_2 + \tfrac{1}{2}O_2 \rightarrow Na_2SO_4 + CO_2$$

$$Na_2CO_3 + SO_3 \rightarrow Na_2SO_4 + CO_2$$

TABLE 3

| Flue Gas Data | | | | |
|---|---|---|---|---|
| Flue gas rate | 1416682 | lb/hr | | |
| $SO_2$ in flue gas | 1075 | lb/hr | 16.80 | lbmol/h |
| $SO_3$ in flue gas | 149 | lb/hr | 1.86 | lbmol/h |

TABLE 3-continued

| Addition of Sodium Bicarbonate | | | | |
|---|---|---|---|---|
| $NaHCO_3$ required for $SO_3$ | 3.7 | lbmol/h | 313 | lb/h |
| $NaHCO_3$ required for $SO_2$ | 33.6 | lbmol/h | 2822 | lb/h |
| Total $NaHCO_3$ Stoichiometric. | 37.3 | lbmol/h | 3135 | lb/h |
| Assuming 115% excess (over stoichiometric) | | | | |
| Total $NaHCO_3$ to be supplied | 39.24 | MT/day | | |
| Solids Exit | | | | |
| Total $Na_2SO_4$ formed | 28.84 | MT/day | | |
| Unreacted $NaHCO_3$ in prod | 5.89 | MT/day | | |
| Total solids exit | 34.73 | MT/day | | |

Table 4 shows an FCC flue gas stream—flow rate, SOx content and NaOH(aq) make-up requirement to desulfurize the flue gas. Table 4 illustrates that make-up water is required to desulfurize the flue gas stream as NaOH is injected in the scrubber as an aqueous solution, typically being 20 wt %. Following desulfurization reactions are taking place:

$$2NaOH + SO_2 \rightarrow Na_2SO_3 + H_2O$$

$$2NaOH + SO_3 \rightarrow Na_2SO_4 + H_2O$$

What is not shown is that a scrubber effluent with a Na-salt concentration of 5-10 wt % will be formed requiring further make-up water to avoid salt precipitation.

TABLE 4

| Flue Gas Data | | | | |
|---|---|---|---|---|
| Flue gas rate | 1416682 | lb/hr | | |
| $SO_2$ in flue gas | 1075 | lb/hr | 16.80 | lbmol/h |
| $SO_3$ in flue gas | 149 | lb/hr | 1.86 | lbmol/h |
| Addition of Caustic Soda | | | | |
| Total equivalent $SO_2$ | 18.7 | lbmol/h | | |
| Total equivalent $SO_2$ | 1194 | lb/h | | |
| Total NaOH Stoichiometric. | 1493 | lb/h | | |
| Total NaOH to be supplied | 81.25 | MT/day | <-- 20% conc. Solution | |
| Total $H_2O$ supplied | 65 | MT/day | 2708 kg/h | |

Example 3—Quench Water Usage: Wet Scrubber Vs Dry Scrubber

Table 5 shows that the use of a wet scrubber with a full combustion FCC regenerator requires 84,430 lb/hr of make-up water for quenching the flue gas to adiabatic saturation temperature. The total amount of water to the atmosphere is 189,361 lb/hr.

TABLE 5

| | 450° F. flue gas, lb/h | 86° F. water quench, lb/h | 166° F. quenched flue gas, lb/h |
|---|---|---|---|
| $CO_2$ | 291,375 | 0 | 291,375 |
| $H_2O$ | 104,931 | 84,430 | 189,361 |
| $O_2$ | 24,135 | 0 | 24,135 |
| $N_2$ | 804,090 | 0 | 804,090 |
| $SO_2$ | 1476 | 0 | 1,476 |
| | 1,226,007 | 84,430 | 1,310,437 |

Table 6 shows the use of a wet scrubber with a partial combustion FCC regenerator requires 112,300 lb/hr of make-up water for quenching the flue gas to the adiabatic saturation temperature. The amount of water emitted to the atmosphere is 205,060 lb/hr.

TABLE 6

| | 450° F. flue gas, lb/h | 86° F. water quench, lb/h | 166° F. quenched flue gas, lb/h |
|---|---|---|---|
| $CO_2$ | 334,059 | 0 | 334,059 |
| $H_2O$ | 137,760 | 112,300 | 250,060 |
| $O_2$ | 32,385 | 0 | 32,385 |
| $N_2$ | 111,8324 | 0 | 1,118,324 |
| $SO_2$ | 1,513 | 0 | 1,513 |
| | 1,624,042 | 112,300 | 1,736,342 |

The use of a DSI system requires no make-up water as desulfurization of the flue gas can be performed at high temperature (above the acid and water dew point). The amount of water to the atmosphere for the full combustion FCC regenerator is 104,931 lb/hr, which is a savings of 45%. The amount of water to the atmosphere for the partial combustion FCC regenerator is 137,760 lb/hr, which is a savings of 45%.

Specific Embodiments

While the following is described in conjunction with specific embodiments, it will be understood that this description is intended to illustrate and not limit the scope of the preceding description and the appended claims.

A first embodiment of the invention is a method for treating flue gas from a fluid catalytic cracking (FCC) unit catalyst regenerator, an FCC unit catalyst regenerator CO-combustor, or a dehydrogenation unit catalyst regenerator comprising transferring heat from an flue gas stream from the FCC unit catalyst regenerator, the FCC unit catalyst regenerator CO-combustor, or the dehydrogenation reactor to a boiler feed water stream in a heat recovery steam generator (HRSG) to form a cooled flue gas stream and a steam stream, wherein the flue gas stream comprises one or more of sulfur-containing compounds, nitrogen-containing compounds, and catalyst fines and wherein the flue gas stream has a temperature in a range of 200° C. to 290° C., the temperature being above a dew point of water and an acid comprising sulfuric acid and/or sulfur trioxide; reacting one or more of the sulfur-containing compounds, the nitrogen-containing compounds, or both in the cooled flue gas stream from the HRSG with a reactant in a decontamination reactor, wherein the reactant comprises one or more of $NaHCO_3$, NaOH, KOH to form a reactor effluent stream comprising one or more of $Na_2SO_4$, $NaNO_3$, $NaNO_2$, $Na_2CO_3$, $K_2SO_4$, and $KNO_3$ while maintaining the reactor effluent stream at a temperature in a range of 200° C. to 290° C.; filtering the reactor effluent stream to remove at least one of the $Na_2SO_4$, $NaNO_3$, $NaNO_2$, $Na_2CO_3$, $K_2SO_4$, $KNO_3$ and the catalyst fines and form a filtered reactor effluent stream; and pre-heating a combustion air stream or a boiler feed water stream with the filtered reactor effluent stream thereby reducing the temperature to 130° C. to 200° C. and staying above the dew point of water. An embodiment of the invention is one, any or all of prior embodiments in this paragraph up through the first embodiment in this paragraph wherein pre-heating the combustion air stream or the boiler feed water stream with the filtered reactor effluent stream comprises pre-heating the combustion air stream or the boiler feed water stream with the filtered reactor effluent stream using a gas/gas heat exchanger or gas/liquid heat exchanger. An embodiment of the invention is one, any or all of prior embodiments in this paragraph up through the first embodiment in this paragraph wherein the flue gas stream comprises a flue gas stream from a partial combustion FCC unit regenerator, and further comprising combusting CO in the flue gas stream in a combustor to form a completely oxidized flue gas stream, wherein transferring heat from the flue gas stream comprises transferring heat from the completely oxidized flue gas stream. An embodiment of the invention is one, any or all of prior embodiments in this paragraph up through the first embodiment in this paragraph wherein the combustion air stream is sent to the CO-combustor. An embodiment of the invention is one, any or all of prior embodiments in this paragraph up through the first embodiment in this paragraph wherein filtering the reactor effluent stream comprises filtering the reactor effluent stream using a bag filter or an electrostatic precipitator. An embodiment of the invention is one, any or all of prior embodiments in this paragraph up through the first embodiment in this paragraph further comprising dividing the filter material stream into two portions; recycling a first portion to the decontamination reactor; and recovering the second portion. An embodiment of the invention is one, any or all of prior embodiments in this paragraph up through the first embodiment in this paragraph wherein the nitrogen-containing compounds are present in the cooled flue gas stream in an amount of less than 1000 ppm(v) on a dry basis. An embodiment of the invention is one, any or all of prior embodiments in this paragraph up through the first embodiment in this paragraph wherein the sulfur-containing compounds are present in the cooled flue gas stream in an amount of less than 5000 ppm(v) on a dry basis. An embodiment of the invention is one, any or all of prior embodiments in this paragraph up through the first embodiment in this paragraph wherein the HRSG comprises a superheated steam section and a saturated steam section, and wherein transferring heat from the flue gas stream to the boiler feed water stream comprises introducing the flue gas stream into the superheated steam section to produce a superheated steam stream and a partially cooled flue gas stream; introducing the boiler feed water stream and the partially cooled flue gas stream into the saturated steam section to produce a saturated steam stream; introducing at least a portion of the saturated steam stream into the superheated steam section; and superheating the saturated steam stream with the flue gas stream to produce the superheated steam stream. An embodiment of the invention is one, any or all of prior embodiments in this paragraph up through the first embodiment in this paragraph wherein the reactant is in dry form or slurry form.

A second embodiment of the invention is a method for treating flue gas from a fluid catalytic cracking (FCC) unit catalyst regenerator, an FCC unit catalyst regenerator CO-combustor, or a dehydrogenation unit catalyst regenerator comprising introducing a flue gas stream from the FCC unit catalyst regenerator, the FCC unit catalyst regenerator CO-combustor, or the dehydrogenation reactor into a superheated steam section of a heat recovery steam generator (HRSG) to produce a superheated steam stream and a partially cooled flue gas stream, wherein the HRSG comprises the superheated steam section and a saturated steam section, wherein the flue gas stream comprises one or more of sulfur-containing compounds, nitrogen-containing compounds, and catalyst fines, and wherein the flue gas stream has a temperature in a range of 200° C. to 290° C., the temperature being above a dew point of water and an acid comprising sulfuric acid and/or sulfur trioxide; introducing a boiler feed water stream and the partially cooled flue gas stream into the saturated steam section of the HRSG to produce a saturated steam stream; introducing at least a portion of the saturated steam stream into the superheated steam section of the HRSG; superheating the saturated steam stream with the flue gas stream to produce the superheated steam stream; reacting one or more of the sulfur-containing compounds, the nitrogen-containing compounds, or both in the cooled flue gas stream from the HRSG with a reactant in a decontamination reactor, wherein the reactant comprises one or more of $NaHCO_3$, NaOH, KOH to form a reactor effluent stream comprising one or more of $Na_2SO_4$, $NaNO_3$, $NaNO_2$, $Na_2CO_3$, $K_2SO_4$, and $KNO_3$ while maintaining the reactor effluent stream at a temperature in a range of 200° C. to 290° C.; filtering the reactor effluent stream using a bag filter or an electrostatic precipitator to remove at least one of the $Na_2SO_4$, $NaNO_3$, $NaNO_2$, $Na_2CO_3$, $K_2SO_4$, $KNO_3$ and the catalyst fines and form a filtered reactor effluent stream; and pre-heating a combustion air stream or a boiler feed water stream with the filtered reactor effluent stream thereby reducing the temperature to 130° C. to 200° C. and staying above the dew point of water. An embodiment of the invention is one, any or all of prior embodiments in this paragraph up through the second embodiment in this paragraph wherein pre-heating the combustion air stream or the boiler feed water stream with the filtered reactor effluent stream comprises pre-heating the combustion air stream or the boiler feed water stream with the filtered reactor effluent stream using a gas/gas heat exchanger or gas/liquid heat exchanger. An embodiment of the invention is one, any or all of prior embodiments in this paragraph up through the second embodiment in this paragraph wherein the flue gas stream comprises a flue gas stream from a partial combustion FCC unit regenerator, and further comprising combusting CO in the flue gas stream in a combustor to form a completely oxidized flue gas stream, wherein transferring heat from the flue gas stream comprises transferring heat from the completely oxidized flue gas stream. An embodiment of the invention is one, any or all of prior embodiments in this paragraph up through the second embodiment in this paragraph wherein the combustion air stream is sent to the CO-combustor. An embodiment of the invention is one, any or all of prior embodiments in this paragraph up through the second embodiment in this paragraph further comprising dividing the filter material stream into two portions; recycling a first portion to the decontamination reactor; and recovering the second portion. An embodiment of the invention is one, any or all of prior embodiments in this paragraph up through the second embodiment in this paragraph wherein the nitrogen-containing compounds are present in the cooled flue gas stream in an amount of less than 1000 ppm(v) on a dry basis. An embodiment of the invention is one, any or all of prior embodiments in this paragraph up through the second embodiment in this paragraph wherein the sulfur-containing compounds are present in the cooled flue gas stream in an amount of less than 5000 ppm(v) on a dry basis. An embodiment of the invention is one, any or all of prior embodiments in this paragraph up through the second embodiment in this paragraph wherein the reactant is in dry form or slurry form.

A third embodiment of the invention is an apparatus for treating flue gas from a fluid catalytic cracking (FCC) unit catalyst regenerator, an FCC unit catalyst regenerator CO-combustor, or a dehydrogenation unit catalyst regenerator comprising a heat recovery steam generator comprising a superheated steam section and a saturated steam section; the superheated steam section having a flue gas inlet, a flue gas outlet, a saturated steam inlet, and a superheated steam outlet, the flue gas inlet of the superheated steam section in fluid communication with an outlet of the FCC unit catalyst regenerator, the FCC unit catalyst regenerator CO-combustor, or the dehydrogenation unit catalyst regenerator; the saturated steam section having a flue gas inlet, a flue gas outlet, a boiler feed water inlet, and a saturated steam outlet, the flue gas inlet of the saturated steam section in fluid communication with the flue gas outlet of the superheated steam section, the saturated steam outlet of the saturated steam section in fluid communication with the saturated steam inlet of the superheated steam section; a decontamination reactor having a flue gas inlet, a flue gas outlet, and a reactant inlet, the flue gas inlet of the decontamination reactor in fluid communication with the flue gas outlet of the saturated steam section; a filter section having a flue gas inlet, a flue gas outlet, and a filter material outlet, flue gas inlet of the filter section in fluid communication with the flue gas outlet of the decontamination reactor inlet; a heat exchanger having a flue gas inlet and a flue gas outlet, the flue gas inlet of the heat exchanger in fluid communication with the flue gas outlet of the filter section, the heat exchanger in thermal communication with a boiler water feed stream; and the boiler water feed stream in fluid communication with the boiler feed water inlet of the saturated steam section. An embodiment of the invention is one, any or all of prior embodiments in this paragraph up through the third embodiment in this paragraph wherein the CO-combustor has a flue gas inlet, a flue gas outlet, and a combustion air inlet, the flue gas outlet of the CO-combustor in fluid communication with the flue gas inlet of the superheated steam section, the heat exchanger in thermal communication with a combustion air stream, the combustion air stream in fluid communication with the combustion air inlet of the CO-combustor.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A method for treating flue gas from a fluid catalytic cracking (FCC) unit catalyst regenerator, an FCC unit catalyst regenerator CO-combustor, or a dehydrogenation unit catalyst regenerator comprising:

transferring heat from flue gas stream from the FCC unit catalyst regenerator, the FCC unit catalyst regenerator CO-combustor, or the dehydrogenation reactor to a boiler feed water stream in a heat recovery steam generator (HRSG) to form a cooled flue gas stream and a steam stream, wherein the flue gas stream comprises one or more of sulfur-containing compounds, nitrogen-containing compounds, and catalyst fines and wherein the flue gas stream has a temperature in a range of 200° C. to 290° C., the temperature being above a dew point of water and an acid comprising sulfuric acid and/or sulfur trioxide;

reacting one or more of the sulfur-containing compounds, the nitrogen-containing compounds, or both in the cooled flue gas stream from the HRSG with a reactant in a decontamination reactor, wherein the reactant comprises one or more of $NaHCO_3$, NaOH, KOH to form a reactor effluent stream comprising one or more of $Na_2SO_4$, $NaNO_3$, $NaNO_2$, $Na_2CO_3$, $K_2SO_4$, and $KNO_3$ while maintaining the reactor effluent stream at a temperature in a range of 200° C. to 290° C.;

filtering the reactor effluent stream to remove at least one of the $Na_2SO_4$, $NaNO_3$, $NaNO_2$, $Na_2CO_3$, $K_2SO_4$, $KNO_3$ and the catalyst fines and form a filtered reactor effluent stream; and pre-heating a combustion air stream or the boiler feed water stream with the filtered reactor effluent stream thereby reducing the temperature to 130° C. to 200° C. and staying above the dew point of water.

2. The method of claim 1 wherein pre-heating the combustion air stream or the boiler feed water stream with the filtered reactor effluent stream comprises pre-heating the combustion air stream or the boiler feed water stream with the filtered reactor effluent stream using a gas/gas heat exchanger or gas/liquid heat exchanger.

3. The method of claim 1 wherein the flue gas stream comprises a flue gas stream from a partial combustion FCC unit regenerator, and further comprising:

combusting CO in the flue gas stream in a combustor to form a completely oxidized flue gas stream, wherein transferring heat from the flue gas stream comprises transferring heat from the completely oxidized flue gas stream.

4. The method of claim 3 wherein the combustion air stream is sent to the CO-combustor.

5. The method of claim 1 wherein filtering the reactor effluent stream comprises filtering the reactor effluent stream using a bag filter or an electrostatic precipitator.

6. The method of claim 1 further comprising:

dividing the filter material stream into two portions;

recycling a first portion to the decontamination reactor; and recovering the second portion.

7. The method of claim 1 wherein the nitrogen-containing compounds are present in the cooled flue gas stream in an amount of less than 1000 ppm(v) on a dry basis.

8. The method of claim 1 wherein the sulfur-containing compounds are present in the cooled flue gas stream in an amount of less than 5000 ppm(v) on a dry basis.

9. The method of claim 1 wherein the HRSG comprises a superheated steam section and a saturated steam section, and wherein transferring heat from the flue gas stream to the boiler feed water stream comprises:

introducing the flue gas stream into the superheated steam section to produce a superheated steam stream and a partially cooled flue gas stream;

introducing the boiler feed water stream and the partially cooled flue gas stream into the saturated steam section to produce a saturated steam stream;

introducing at least a portion of the saturated steam stream into the superheated steam section; and superheating the saturated steam stream with the flue gas stream to produce the superheated steam stream.

10. The method of claim 1 wherein the reactant is in dry form or slurry form.

11. A method for treating flue gas from a fluid catalytic cracking (FCC) unit catalyst regenerator, an FCC unit catalyst regenerator CO-combustor, or a dehydrogenation unit catalyst regenerator comprising:

introducing a flue gas stream from the FCC unit catalyst regenerator, the FCC unit catalyst regenerator CO-combustor, or the dehydrogenation reactor into a superheated steam section of a heat recovery steam generator (HRSG) to produce a superheated steam stream and a partially cooled flue gas stream, wherein the HRSG comprises the superheated steam section and a saturated steam section, wherein the flue gas stream comprises one or more of sulfur-containing compounds, nitrogen-containing compounds, and catalyst fines, and wherein the flue gas stream has a temperature in a range of 200° C. to 290° C., the temperature being above a dew point of water and an acid comprising sulfuric acid and/or sulfur trioxide;

introducing a boiler feed water stream and the partially cooled flue gas stream into the saturated steam section of the HRSG to produce a saturated steam stream;

introducing at least a portion of the saturated steam stream into the superheated steam section of the HRSG;

superheating the saturated steam stream with the flue gas stream to produce the superheated steam stream;

reacting one or more of the sulfur-containing compounds, the nitrogen-containing compounds, or both in the cooled flue gas stream from the HRSG with a reactant in a decontamination reactor, wherein the reactant comprises one or more of $NaHCO_3$, NaOH, KOH to form a reactor effluent stream comprising one or more of $Na_2SO_4$, $NaNO_3$, $NaNO_2$, $Na_2CO_3$, $K_2SO_4$, and $KNO_3$ while maintaining the reactor effluent stream at a temperature in a range of 200° C. to 290° C.;

filtering the reactor effluent stream using a bag filter or an electrostatic precipitator to remove at least one of the $Na_2SO_4$, $NaNO_3$, $NaNO_2$, $Na_2CO_3$, $K_2SO_4$, $KNO_3$ and the catalyst fines and form a filtered reactor effluent stream; and pre-heating a combustion air stream or the boiler feed water stream with the filtered reactor effluent stream thereby reducing the temperature to 130° C. to 200° C. and staying above the dew point of water.

12. The method of claim 11 wherein pre-heating the combustion air stream or the boiler feed water stream with the filtered reactor effluent stream comprises pre-heating the combustion air stream or the boiler feed water stream with the filtered reactor effluent stream using a gas/gas heat exchanger or gas/liquid heat exchanger.

13. The method of claim 11 wherein the flue gas stream comprises a flue gas stream from a partial combustion FCC unit regenerator, and further comprising:

combusting CO in the flue gas stream in a combustor to form a completely oxidized flue gas stream, wherein transferring heat from the flue gas stream comprises transferring heat from the completely oxidized flue gas stream.

14. The method of claim 13 wherein the combustion air stream is sent to the CO-combustor.

15. The method of claim 11 further comprising:

dividing the filter material stream into two portions;

recycling a first portion to the decontamination reactor; and recovering the second portion.

16. The method of claim 11 wherein the nitrogen-containing compounds are present in the cooled flue gas stream in an amount of less than 1000 ppm(v) on a dry basis.

17. The method of claim 11 wherein the sulfur-containing compounds are present in the cooled flue gas stream in an amount of less than 5000 ppm(v) on a dry basis.

18. The method of claim 11 wherein the reactant is in dry form or slurry form.

19. An apparatus for treating flue gas from a fluid catalytic cracking (FCC) unit catalyst regenerator, an FCC unit catalyst regenerator CO-combustor, or a dehydrogenation unit catalyst regenerator comprising:

a heat recovery steam generator comprising a superheated steam section and a saturated steam section;

the superheated steam section having a flue gas inlet, a flue gas outlet, a saturated steam inlet, and a superheated steam outlet, the flue gas inlet of the superheated steam section in fluid communication with an outlet of the FCC unit catalyst regenerator, the FCC unit catalyst regenerator CO-combustor, or the dehydrogenation unit catalyst regenerator;

the saturated steam section having a flue gas inlet, a flue gas outlet, a boiler feed water inlet, and a saturated steam outlet, the flue gas inlet of the saturated steam section in fluid communication with the flue gas outlet of the superheated steam section, the saturated steam outlet of the saturated steam section in fluid communication with the saturated steam inlet of the superheated steam section;

a decontamination reactor having a flue gas inlet, a flue gas outlet, and a reactant inlet, the flue gas inlet of the decontamination reactor in fluid communication with the flue gas outlet of the saturated steam section;

a filter section having a flue gas inlet, a flue gas outlet, and a filter material outlet, flue gas inlet of the filter section in fluid communication with the flue gas outlet of the decontamination reactor inlet;

a heat exchanger having a flue gas inlet and a flue gas outlet, the flue gas inlet of the heat exchanger in fluid communication with the flue gas outlet of the filter section; and the heat exchanger in fluid communication with the boiler feed water inlet of the saturated steam section.

20. The apparatus of claim 19 wherein the CO-combustor has a flue gas inlet, a flue gas outlet, and a combustion air inlet, the flue gas outlet of the CO-combustor in fluid communication with the flue gas inlet of the superheated steam section, the heat exchanger in fluid communication with the combustion air inlet of the CO-combustor.

* * * * *